United States Patent [19]

Danenberg et al.

[11] Patent Number: 4,491,818

[45] Date of Patent: Jan. 1, 1985

[54] PICKUP COIL ASSEMBLY WITH COAXIAL FEED

[75] Inventors: Bernard D. Danenberg, Skokie; Arthur J. Lostumo, Franklin Park, both of Ill.

[73] Assignee: Zenith Electronics Corporation, Glenview, Ill.

[21] Appl. No.: 480,551

[22] Filed: Mar. 30, 1983

[51] Int. Cl.[3] ..... H01F 27/04; H01F 40/06

[52] U.S. Cl. ..... 336/65; 336/92; 336/174; 336/192

[58] Field of Search ..... 336/173, 174, 175, 192, 336/96, 65, 90, 92; 324/127; 174/92, 153 G

[56] References Cited

U.S. PATENT DOCUMENTS

| | | | |
|---|---|---|---|
| 3,183,302 | 5/1965 | Wochner et al. | 174/92 X |
| 3,721,747 | 3/1973 | Renskers | 336/96 X |
| 3,846,725 | 11/1974 | Mears, Jr. | 174/92 X |

FOREIGN PATENT DOCUMENTS

| | | | |
|---|---|---|---|
| 912739 | 8/1946 | France | 336/174 |
| 1069337 | 7/1954 | France | 336/174 |
| 29049 | 6/1964 | German Democratic Rep. | 336/174 |
| 129424 | 10/1979 | Japan | 336/174 |
| 131721 | 10/1979 | Japan | 336/174 |

*Primary Examiner*—Thomas J. Kozma

[57] ABSTRACT

A pickup coil assembly comprises a pancake-shaped coil mounted in a plastic form having a pair of parallel support posts therethrough. The form is positioned in a plastic housing having a central aperture in one wall formed by cut away jaw portions for gripping a conductor inserted therethrough. A back wall of the housing includes a co-axial aperture of larger dimension to permit free passage of the conductor.

7 Claims, 12 Drawing Figures

PICKUP COIL ASSEMBLY WITH COAXIAL FEED

BACKGROUND OF THE INVENTION AND PRIOR ART

This invention relates to coil mountings in general and specifically to mounting of signal pickup coils.

In regulated power supplies especially those of the switch-mode type, it is well known to pass a current carrying conductor through a pickup coil which senses current changes therein and communicates the changes to regulating means for adjusting the power supply output accordingly. The "pancake" shaped pickup coils are quite often small and fragile and are generally housed in a mounting device having support posts for connection to a printed circuit board or the like. The pickup coil may be conventional and wound on a bobbin type form or may be toroidal and wound about a donut shaped ferrite core for higher frequency applications.

Present manufacturing techniques involve positioning a pickup coil on a support, placing the current carrying conductor in position through the central opening of the support and pickup coil, maintaining the respective conductor and coil positions while an epoxy cement locks the conductor to the coil, mounting the assembly to a printed circuit board and terminating the conductor. The pickup coil and conductor are thus maintained in a fixed relative position which satisfies various certification agencies such as Underwriters Laboratories and the Canadian Standards Association. In many power supply installations the signal pickup coil must be carefully positioned because contact with the conductor could compromise system power line isolation.

The above assembly technique, while generally effective, is time consuming and requires some operator skill. It also leads to waste if the proper length of conductor is not provided on each side of the coil, necessitating a new assembly. Consequently, there is a need in the art for a pickup coil assembly that would solve these problems and provide means for simply holding the conductor in fixed relationship to the coil and for permitting subsequent axial adjustment of the conductor, if needed.

OBJECTS OF THE INVENTION

Accordingly, an object of this invention is to provide an improved pickup coil assembly.

Another object of this invention is to provide a pickup coil assembly which automatically positions a conductor inserted therethrough.

A still further object of the invention is to provide a novel pickup coil assembly which minimizes the need for operator skill.

SUMMARY OF THE INVENTION

In accordance with the invention, a pickup coil assembly includes an opening therethrough and support means, fixed with respect to the coil, defining an aperture in substantial alignment with the opening in the coil assembly. Holding means are provided adjacent to the aperture for holding a conductor in position in the opening.

BRIEF DESCRIPTION OF THE DRAWING

Further objects and advantages of the invention will become apparent upon reading the following description in conjunction with the drawing in which.

DESCRIPTION OF THE PREFERRED EMBODIMENT

Figure 1:
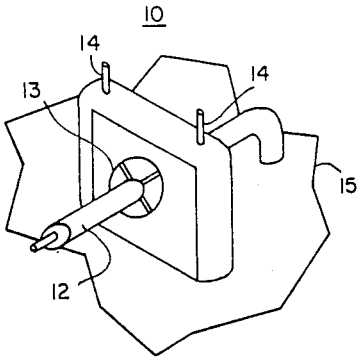
FIG. 1 represents a perspective view of a pickup coil assembly constructed in accordance with the invention.

Referring to FIG. 1, a pickup coil assembly 10 includes a housing 11 of generally square configuration with a conductor 12 passing through a central aperture 13 in the housing. While conductor 12 is illustrated as having an insulating jacket, it may comprise a bare wire. A pair of support posts 14 extend vertically through the housing and, as will be seen, are used to mount the pickup coil assembly to a printed circuit board 15 or the like.

The housing may be constructed of any suitable plastic material such as that commonly available under the tradename Noryl. The coil assembly and conductor may be connected to the circuit board by conventional means such as soldering.

Figure 2:
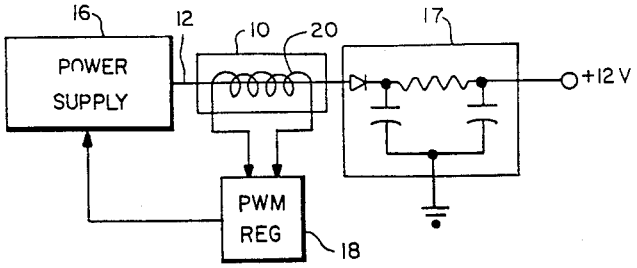
FIG. 2 represents a schematic diagram of a regulated power supply circuit incorporating a pickup coil assembly.
Figure 3:
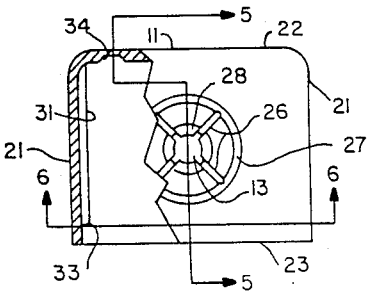
FIG. 3 is a partially broken away front elevation of the housing of the pickup coil assembly.
Figure 4:
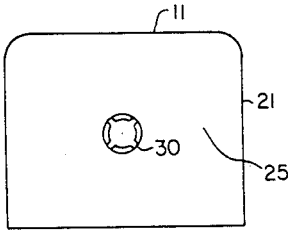
FIG. 4 is a rear elevation of the housing.
Figure 5:
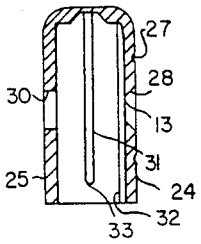
FIG. 5 is a section through the housing of FIG. 3 taken along lines 5—5.

In FIG. 2 a simplified schematic diagram of a power supply arrangement incorporating a pickup coil assembly is shown. A power supply 16 supplies regulated current over conductor 12 to a rectifier-filter arrangement 17 which produces a DC output voltage, generally on the order of 12 volts. Pickup coil assembly 10 includes a pickup coil 20 through which conductor 12 passes and which communicates with a Pulse Width Modulator regulator 18 for controlling the power supply output as a function of the magnitude of current flowing in conductor 12. It will be appreciated that the power supply circuit indicated is illustrative only and that other types of power supplies may be used with equal facility.

Referring to FIGS. 3 through 6, the housing for the pickup coil assembly is shown. Housing 11 includes left and right sidewalls 21, a top wall 22, a front wall 24, a back wall 25 and an open bottom 23. The front and back walls are flat whereas the other walls are slightly rounded. The holding means of the invention are defined by an aperture 13 in the center of front wall 24 and the four slots 26 extending from aperture 13 in cruciform fashion. A circular recess 27 is formed in front wall 24, concentric with aperture 13, and engages the ends of slots 26. Recess 27 enables the cut away jaw portions 28 of wall 24 to flex out of the plane of the wall when a conductor is inserted at a right angle thereto. The ends of jaw portions 28 are tapered to assist in biting into and holding the insulated jacket of conductor 12 and the opening formed thereby is slightly smaller than the diameter of the conductor. An aperture 30, slightly larger in diameter than aperture 13, is formed in back wall 25 concentric with aperture 13.

Figure 6:
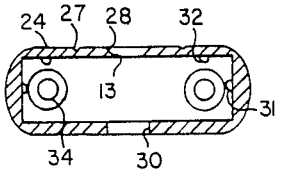
FIG. 6 is a section of the housing of FIG. 3 taken along lines 6—6.
Figure 7:
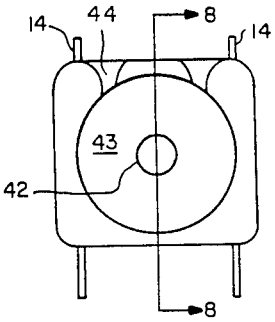
FIG. 7 is a plan view of a mounting element for supporting the pickup coil.
Figure 8:
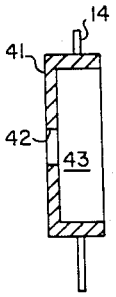
FIG. 8 is a section of the mounting element of FIG. 7 taken along lines 8—8.

The interior of the housing includes a pair of side spacers 31 formed in side walls 21. The spacers are terminated short of open bottom 23 to form guides 33 for aiding insertion on the coil and mounting element into the housing. A pair of spacers 32, formed on the inside surface of front wall 24, serve to position the mounting element and coil a small distance from the front wall to permit inward deflection of jaws 28 during insertion of the conductor in aperture 13. This construction is best illustrated in FIG. 6 as are the beveled holes 34 in top wall 22 which enable passage of support posts 14 as well as compensate for slight misalignment in support post spacing.

Figure 9:
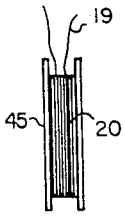
FIG. 9 is an end elevation of a bobbin type pickup coil.
Figure 10:
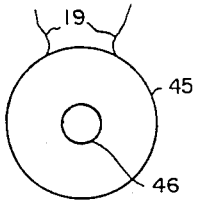
FIG. 10 is a side elevation of the bobbin type pickup coil of FIG. 9.

Referring to FIGS. 7 through 11, a mounting element 41 for the pancake shaped pickup coil is shown. In FIGS. 9 and 10 the coil is illustrated as being wound on a bobbin 45, whereas in FIG. 11 a toroidal coil is shown. The mounting element includes a central opening 42, which is larger than aperture 30 to provide clearance, a large circular recess 43 for retaining coil 20 and form 45 and a pair of channels 44 to enable passage of the wires from the coil across the surface of the mounting element for connection to support posts 14. Form 45 includes a central opening 46 which is preferably slightly larger than opening 42 in mounting element 41. The support posts extend through the mounting element, which may comprise a plastic material with the posts 14 molded in. Form 45, with coil 20 therein is adapted to be positioned in recess 43 and the coil leads 19 adapted to pass through channels 44, respectively and connected to the support posts. The dimensions of form 45 are selected to produce a close fit in recess 43.

Figure 11:
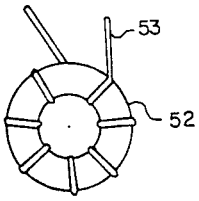
FIG. 11 is a side elevation of a toroidal type pickup coil.

FIG. 11 shows a toroidal type coil in which a ferrite core 52 of donut configuration has a coil 53 wound thereon. The functioning of the coil assembly of the invention is the same whether a bobbin type or toroidal type coil is used.

Figure 12:
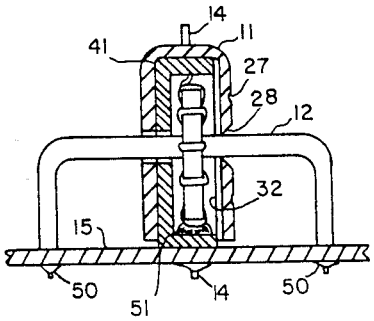
FIG. 12 is a sectional view through an assembled pickup coil assembly with a toroidal pickup coil.

FIG. 12 shows a cross section of the pickup coil assembly of the invention installed on a printed circuit board 15. Spacers 32 on the inner surface of front wall 24 position mounting element 41 slightly away from tapered jaws 28 to provide clearance for the deflection they undergo during insertion of conductor 12 (from left to right as shown in the illustration). The ends of conductor 12 and the lower portions of posts 14 are inserted through appropriate holes in printed circuit board 15 and soldered to foil patterns thereon (not shown) as illustrated by solder fillets 50. With the toroidal coil shown a glue or other type of supporting material 51 may be used to support the coil. Alternately, the coil may be appropriately sized to fit snugly within mounting element 41.

In assembly, a pickup coil 20 is placed in recess 43 of mounting element 41 and leads 19 positioned in channels 44 and soldered, or otherwise terminated, to support posts 14. The mounting element is then inserted into housing 11 with support posts 14 entering beveled holes 34 in top wall 22. The spacers in the housing provide a close fit with mounting element 41. A conductor 12 of suitable length is inserted into aperture 13 of the housing to the proper length required. Support posts 14 and the ends of conductor 12 are mounted to prepared holes in printed circuit board 15 and suitably soldered. Should an error occur and conductor 12 be inserted an insufficient distance, for example, the operator need merely insert the conductor farther. If conductor 12 has been inserted too far, or if the wrong type of conductor has been inserted, the conductor may be removed by simply pulling it completely through aperture 13, and replaced with the proper length or size conductor.

Thus, with the invention a pickup coil assembly is provided which correctly positions and retains a conductor within the coil opening instantly and with a minimum exercise of operator skill. It is recognized that numerous modifications in the described embodiment of the invention will be apparent to those skilled in the art without departing from its true spirit and scope. The invention is to be limited only as defined in the claims.

What is claimed is:

1. In combination with a pancake shaped signal pickup coil defining an opening therethrough, means for maintaining a fixed substantially right angle relationship between said coil and a current carrying conductor in said opening comprising:

a housing of substantially larger configuration than said coil;

support means mounted in a fixed, partially surrounding relationship to said coil and adapted to fit within said housing, said support means defining an aperture in substantial alignment with said opening; and partially cut away jaw portions formed in a wall of said housing around said aperture for engaging and holding a conductor in position in said opening, said jaw portions permitting movement of said conductor in a single axial direction.

2. The combination of claim 1 wherein said support means include a pair of parallelly displaced conductive support posts adapted for engagement with a printed circuit board or the like.

3. The combination of claim 2 wherein said coil is electrically connected to said support posts.

4. The combination of claim 3 wherein said support means further include a mounting element configured to accept said coil therein and said conductor therethrough, said support posts being embedded in said mounting element.

5. The combination of claim 4 wherein said housing includes spacers for spacing said mounting element away from said cut away jaw portions to enable flexure thereof upon insertion of a conductor in said aperture.

6. A pickup coil assembly comprising:

a pancake shaped coil;

housing means including support means for mounting to a printed circuit board of the like;

jaw portions formed in a wall of said housing means defining an aperture for engaging and holding a conductor in fixed position therein, said jaw portions permitting movement of said conductor in a single axial direction; and means including a mounting element partially surrounding said coil for mounting said coil in said housing means with said opening of said coil in substantial alignment with said aperture.

7. The assembly of claim 6 wherein said housing means is adapted to snugly fit over said mounting element and further includes spacer means for maintaining separation between said mounting element and said cut away jaw portions for enabling deflection of said cut away jaw portions upon insertion of said conductor.

* * * * *